US010724408B2

(12) United States Patent
England et al.

(10) Patent No.: US 10,724,408 B2
(45) Date of Patent: Jul. 28, 2020

(54) UNIQUE OIL AS A SERVICE EVENT

(71) Applicant: CUMMINS INC., Columbus, IN (US)

(72) Inventors: Roger Dale England, Loudon, TN (US); James D. Kahlenbeck, Columbus, IN (US); Corey W. Trobaugh, Columbus, IN (US)

(73) Assignee: Cummins Inc., Columbus, IN (US)

( * ) Notice: Subject to any disclaimer, the term of this patent is extended or adjusted under 35 U.S.C. 154(b) by 338 days.

(21) Appl. No.: 15/572,901

(22) PCT Filed: May 19, 2016

(86) PCT No.: PCT/US2016/033305

§ 371 (c)(1),
(2) Date: Nov. 9, 2017

(87) PCT Pub. No.: WO2016/191208

PCT Pub. Date: Dec. 1, 2016

(65) Prior Publication Data

US 2018/0112566 A1 Apr. 26, 2018

Related U.S. Application Data

(60) Provisional application No. 62/165,266, filed on May 22, 2015.

(51) Int. Cl.
*F01M 11/04* (2006.01)
*C10M 105/32* (2006.01)
(Continued)

(52) U.S. Cl.
CPC ..... *F01M 11/0458* (2013.01); *C10M 105/06* (2013.01); *C10M 105/32* (2013.01);
(Continued)

(58) Field of Classification Search
CPC ..... F01M 7/00; F01M 9/00; F01M 11/0458
(Continued)

(56) References Cited

U.S. PATENT DOCUMENTS 2,279,001 A * 4/1942 Matheson ..... C10L 10/06 510/185
4,734,215 A * 3/1988 Prigge ..... C23G 5/024 510/407

(Continued)

FOREIGN PATENT DOCUMENTS

GB 1 353 561 8/1970
WO WO-2010/097624 9/2010

OTHER PUBLICATIONS

Amsoil, "Amsoil FAQ Page" (Mar. 18, 2015)(online) retrieved on Nov. 9, 2017, Retrieved from the Internet <URL: http://web.archive.org/web/20150318202034/http://www.amsoil.com/frequent.aspx> p. 1-3.

(Continued)

*Primary Examiner* — Michael R Mansen
*Assistant Examiner* — Mark K Buse
(74) *Attorney, Agent, or Firm* — Foley & Lardner LLP

(57) ABSTRACT

A method of performing a cleanup service on an internal combustion engine. The method involves draining used fleet oil from the engine, filling the engine with cleanup oil, draining the cleanup oil after an operation interval, and filling the engine with fresh fleet oil. The method can be performed as a remedial measure for an engine already exhibiting high oil consumption, or as a preventative measure on a healthy engine.

25 Claims, 2 Drawing Sheets

(51) Int. Cl.

| | |
|---|---|
| ***C10M 107/02*** | (2006.01) |
| ***F01M 9/00*** | (2006.01) |
| ***C11D 1/00*** | (2006.01) |
| ***F01M 7/00*** | (2006.01) |
| ***C10M 105/06*** | (2006.01) |
| ***C11D 7/24*** | (2006.01) |
| ***C11D 7/26*** | (2006.01) |
| ***C11D 11/00*** | (2006.01) |

(52) U.S. Cl.
CPC ..... *C10M 107/02* (2013.01); *C11D 1/00* (2013.01); *C11D 7/24* (2013.01); *C11D 7/266* (2013.01); *C11D 11/0041* (2013.01); *F01M 7/00* (2013.01); *F01M 9/00* (2013.01); *F01M 11/04* (2013.01); *C10M 2203/065* (2013.01); *C10M 2205/0206* (2013.01); *C10M 2207/2805* (2013.01); *C10N 2230/04* (2013.01); *C10N 2240/10* (2013.01)

(58) Field of Classification Search
USPC ..... 184/1.5
See application file for complete search history.

(56) References Cited

U.S. PATENT DOCUMENTS

| | | | | | |
|---|---|---|---|---|---|
| 4,884,660 | A | | 12/1989 | Bedi | |
| 5,062,398 | A | * | 11/1991 | Bedi | F01M 11/0458 123/196 R |
| 5,069,799 | A | | 12/1991 | Brownawell et al. | |
| 5,090,376 | A | * | 2/1992 | Bedi | F01M 11/0458 123/196 R |
| 5,094,201 | A | * | 3/1992 | Bedi | F01M 11/03 123/196 A |
| 5,289,837 | A | | 3/1994 | Betancourt | |
| 5,337,708 | A | * | 8/1994 | Chen | B08B 3/04 123/198 A |
| 5,460,656 | A | * | 10/1995 | Waelput | F02B 77/04 123/196 A |
| 5,792,730 | A | | 8/1998 | Gutierrez et al. | |
| 5,833,765 | A | | 11/1998 | Flynn et al. | |
| 5,900,155 | A | | 5/1999 | Bedi | |
| 6,263,889 | B1 | * | 7/2001 | Flynn | F02B 77/04 134/102.2 |
| 7,947,093 | B2 | | 5/2011 | Barton et al. | |
| 2004/0020720 | A1 | * | 2/2004 | Flynn | F01M 11/04 184/1.5 |
| 2004/0035640 | A1 | * | 2/2004 | Barnard | B08B 9/032 184/1.5 |
| 2005/0115769 | A1 | * | 6/2005 | Blount | F01M 7/00 184/1.5 |
| 2005/0215441 | A1 | | 9/2005 | Mackney et al. | |
| 2010/0286002 | A1 | * | 11/2010 | Adamczewska | C10M 159/20 508/154 |
| 2018/0112566 | A1 | * | 4/2018 | England | F01M 11/0458 |

OTHER PUBLICATIONS

Amsoil, "Amsoil Premium Protection Synthetic Motor Oil" (Apr. 2015) online, retrieved on Nov. 9, Retrieved from the Internet <URL: https://www.amsoil.com/lit/databulletins/g2212.pdf> p. 2.

AskPatty.com, "Mobil 1 Shares the Truth About Synthetic Motor Oils" (Mar. 16, 2009, online, retrieved on Nov. 9, 2017, retrieved from the Internet <URL: http://caradvice.askpatty.com/ask_patty_/2009/03/mobil-1-shares-the-truth-about-synthetic-motor-oils.html#sthash.xfjLnLu9.IpcC8Qd1.dpbs> entire document, especially p. 3.

ExxonMobil, "Synthetic Lubricant Base Stocks Formulations Guide" (2013) (online) retrieved on Nov. 9, 2017, retrieved from the Internet <URL>: http://www.palmerholland.com/news/file.axd?file=/2015/Documents/Synthetics%20Lubricant%20Basestock%20Brochure.pdf> p. 4-5, 10-11.

GlobalSpec, "Synthetic Oils, Greases, and Lubricants Information," (Mar. 15, 2015), online—retrieved on Nov. 9, 2017; Retrieved from the internet, <URL: http://web.archive.org/web/20150315234142/http://www.globalspec.com/learnmore/materials_chemicals_adhesives/industrial_oils_fluids/synthetic_oils_greases_lubricants> p. 1-2.

International Search Report from corresponding PCT application No. PCT/US2016/033305, dated Aug. 30, 2016, pp. 1-2.

John Paul, "Car Doctor: Switching between synthetic and regular oil is OK" Providence Journal (Oct. 25, 2014), online, retrieved on Nov. 8, 2017, retrieved from the Internet <URL: http://www.providencejournal.com/article/20141025/business/310259940> p. 1.

Mobil, "Mobil 1 High Mileage" (Dec. 20, 2014) online, retrieved on Nov. 9, 2017, Retrieved from the Internet <URL: http://web.archieve.org/web/20141220114756/https://mobiloil.com/en/motor-oils/mobil-1-high-mileage> p. 1.

* cited by examiner

UNIQUE OIL AS A SERVICE EVENT

CROSS-REFERENCE TO RELATED APPLICATIONS

This application claims the benefit of and priority to PCT Application No. PCT/US2016/033305, filed on May 19, 2016, which claims the benefit of and priority to U.S. Provisional Patent Application No. 62/165,266, filed on May 22, 2015, the contents of which are incorporated herein by reference in their entirety.

TECHNICAL FIELD

The present disclosure relates generally to the field of internal combustion engines.

BACKGROUND

Internal combustion engines operate via a controlled ignition of air and fuel within a combustion chamber, relying on several moving parts. These moving parts can be configured to perform alternating or continuing movements at high speeds, for example up to several thousand cycles per minute. As such, internal combustion engines continuously distribute lubricating oils throughout the engine to reduce friction from the moving parts.

In addition, oils serve to facilitate sealing associated with the combustion chamber, particularly with respect to seals related to moving parts that interface with and move relative to the combustion chamber. In the event that such seals fail, an excess amount of oil can seep into the combustion chamber and ignite along with the air and fuel, resulting in a higher than normal consumption of oil.

One of the causes of failing seals is an accumulation of particulate matter, varnish, hard carbon and/or oil sludge at and around the combustion chamber. Over the course of service, environmental and operational particulate matter can accumulate within an engine, forming a sludge. As the sludge circulates along with the oil within the engine, the particulate matter can accumulate at the sealing points associated with a combustion chamber, thereby causing the seals to fail. Cleaning up the sludge and particulate matter can involve opening up the engine and manually cleaning each affected component part, which means removing the engine from service and costing several hours of labor.

SUMMARY

In an aspect, a method of performing a cleanup service on an internal combustion engine includes draining used fleet oil from the internal combustion engine, filling the internal combustion engine with a first cleanup oil, draining the first cleanup oil after an operation interval, and filling the internal combustion engine with fresh fleet oil. The method may further include, before filling the internal combustion engine with the first cleanup oil, flushing the internal combustion engine with a second cleanup oil. The first cleanup oil or the second cleanup oil may include an ester-based oil, an alkylated naphthalene and a polyalphaolefin base oil. In some embodiments, the first cleanup oil or the second cleanup includes a non-petroleum-based oil. In some embodiments, the first cleanup oil has a same formulation as the second cleanup oil. In other embodiments, the first cleanup oil has a different formulation than the second cleanup oil. In some embodiments, the operation interval is at least 30,000 miles. In other embodiments, the operation interval is at least 20,000 miles. The first cleanup oil can dissolve at least one of sludge, varnish, and hard carbon in the internal combustion engine, and draining the first cleanup oil after an operation interval includes draining the dissolved at least one of sludge, varnish, and hard carbon from the internal combustion engine. The dissolving and draining of the at least one of sludge, varnish, and hard carbon cleans an interior of the internal combustion engine.

In an aspect, a method of performing a cleanup service on an internal combustion engine includes flushing the internal combustion engine by concurrently adding a first cleanup oil into the internal combustion engine and draining the first cleanup oil from the internal combustion engine for a first period of time, draining the first cleanup oil from the internal combustion engine after the first period of time, filling the internal combustion engine with a second cleanup oil, draining the second cleanup oil from the internal combustion engine after an operation interval, and filling the internal combustion engine with fresh fleet oil. In some embodiments, the first cleanup oil has a same formulation as the second cleanup oil. In other embodiments, the first cleanup oil has a different formulation than the second cleanup oil. In some embodiments, the first cleanup oil and the second cleanup oil each comprise a non-petroleum-based oil. In some embodiments, the operation interval is at least 30,000 miles. In other embodiments, the operation interval is at least 20,000 miles. The second cleanup oil can dissolve at least one of sludge, varnish, and hard carbon in the internal combustion engine, and draining the second cleanup oil after an operation interval includes draining the dissolved at least one of sludge, varnish, and hard carbon from the internal combustion engine. The dissolving and draining of the at least one of sludge, varnish, and hard carbon can clean an interior of the internal combustion engine.

In an aspect, a method of performing a cleanup service on an internal combustion engine includes concurrently adding flushing cleanup oil into the internal combustion engine and draining the flushing cleanup oil from the internal combustion engine for a first period of time, filling the internal combustion engine with an operating cleanup oil comprising an ester-based oil, an alkylated naphthalene and a polyalphaolefin base oil, draining the operating cleanup oil from the internal combustion engine after an operation interval, and filling the internal combustion engine with fresh fleet oil. In some embodiments, the operating cleanup oil includes non-cleanup fleet oil. In some embodiments, the flushing cleanup oil comprises a non-petroleum-based oil. In some embodiments, the operation interval is at least 30,000 miles. In other embodiments, the operation interval is at least 20,000 miles. The flushing cleanup oil can dissolve at least one of sludge, varnish, and hard carbon in the internal combustion engine, and draining the flushing cleanup oil after an operation interval includes draining the dissolved at least one of sludge, varnish, and hard carbon from the internal combustion engine.

BRIEF DESCRIPTION OF THE DRAWINGS

The foregoing and other features of the present disclosure will become more fully apparent from the following description and appended claims, taken in conjunction with the accompanying drawings. It is to be understood that these drawings depict several implementations in accordance with the disclosure and are not to be considered limiting of its scope.

Figure 1:
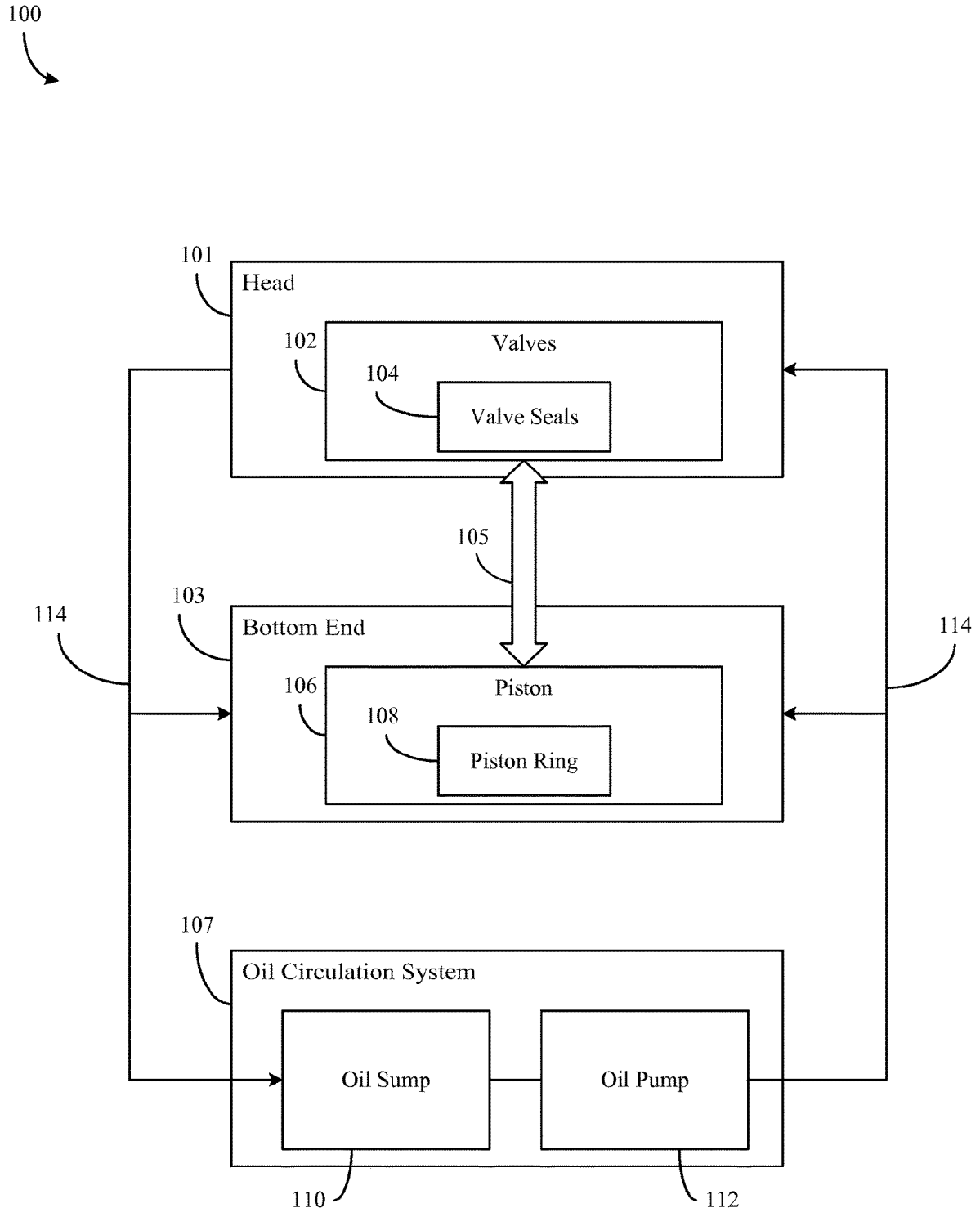
FIG. 1 is a schematic diagram showing the circulation of oil in an internal combustion engine, according to an example embodiment.

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein and illustrated in the figures, can be arranged, substituted, combined, and designed in a wide variety of different configurations, all of which are explicitly contemplated and made part of this disclosure.

DETAILED DESCRIPTION

Referring to FIG. 1, an illustration in block diagram form of an internal combustion engine 100 is shown. The components as illustrated in FIG. 1 are not intended to be necessarily representative of relative physical size or position of the components with respect to each other. The engine 100 includes a head 101, a bottom end 103, and an oil circulation system 107. Components disposed within the head 101 and the bottom end 103 together allow for the operation of a combustion chamber 105. The combustion chamber 105 is a designated space within the engine where a controlled amount of intake air (which, in some embodiments, may include an amount of exhaust gas or other gas) is collected along with a controlled amount of combustible fuel, and the mixture of intake air and fuel is ignited. Upon ignition, the combustible fuel is predominantly spent and exhaust gas is expelled from the combustion chamber. In some arrangements, the combustion chamber 105 is a cylindrical chamber with a concentric bore (e.g., in a piston-based engine). In other arrangements, the combustion chamber 105 is a chamber configured to accommodate a rotor (e.g., in a rotary-based internal combustion engine).

The head 101 is configured to regulate flow of intake air into the combustion chamber and exhaust gases from the combustion chamber, respectively through intake and exhaust ports. The head 101 can include valves 102 corresponding to the intake and exhaust ports. In some embodiments, the intake and exhaust ports are cylindrical bores disposed within the head 101, and are in fluid communication with the combustion chamber 105 at one end, and the atmosphere at another other end. In some embodiments, each of the valves 102 is disposed in a respecting one of the intake ports and the exhaust ports and is configured to alternate between an open configuration (e.g., allowing flow into or out of the combustion chamber 105) and a closed configuration (e.g., preventing flow into or out of the combustion chamber 105). The valves 102 include corresponding valve seals 104. A valve seal 104 inhibits or prevents the flow of intake or exhaust gases when the corresponding valve is in a closed configuration.

The bottom end 103 of the internal combustion engine 100 may contain the combustion chamber 105 and a corresponding piston 106. The piston 106 is a cylinder concentrically disposed within the combustion chamber 105, and is allowed a substantially one-dimensional range of movement within. For example, in a four-stroke engine, the piston 106 is configured such that it is disposed at a first end of the combustion chamber 105 when combustible fuel and intake air are collected, pushed to a second end of the combustion chamber 105 as the fuel and intake air are compressed, forced to the first end of the combustion chamber 105 upon ignition of the collected fuel and air, and pushed to the second end of the combustion chamber 105 as exhaust gas is expelled.

The piston 106 includes at least one piston ring 108. The piston ring 108 is a circular ring of material annularly disposed about the piston 106. In some arrangements, the piston ring 108 is disposed within a corresponding annular groove disposed about the circumference of the piston 106, and may be allowed a limited degree of movement relative to the piston 106. In addition, in some embodiments, the piston ring 108 comprises a material with an elastic characteristic, and thus applies a degree of lateral force against an inner wall of the combustion chamber 105. The piston ring 108 can be configured to form a seal between the outer circumference of the piston 106 and the inner wall of the combustion chamber 105. The piston ring 108 can also be configured to regulate the distribution of oil around the piston 106 and along the inner wall of the combustion chamber 105. In some arrangements, more than one piston ring 108 is disposed about a given piston 106, and individual piston rings can perform or contribute to different functions.

The oil circulation system 107 is configured to provide a lubricant (e.g., motor oil) to various components of the head 101 and the bottom end 103. The oil circulation system 107 includes an oil sump 110, an oil pump 112, and oil conduits 114. The oil sump 110 is a designated area where oil distributed throughout the engine 100 is collected (e.g., an oil pan). In one arrangement, oil collects in the oil sump 110 as a result of gravity. The oil pump 112 is in fluid receiving communication with the oil sump 110, and provides an increase in fluid pressure sufficient to drive oil through the oil conduits 114 to various components and areas of the engine 100.

The oil conduits 114 transport oil from the oil pump 112 to the head 101 and the bottom end 103, where the oil can then be distributed to components that are subject to significant amounts of friction over the course of normal engine operation (e.g., the piston 106, the piston ring 108, the valve 102 and the valve seal 104). For example, in the head 101, oil can be distributed by a gallery of openings in fluid communication with one of the oil conduits and disposed adjacent to the valves 102, associated valve springs, a camshaft, and associated bearings. In the bottom end 103, oil can be distributed via openings in fluid communication with one of the oil conduits and disposed in or adjacent to the piston 106, the piston ring 108, a crank, a rod, and associated bearings. As such, oil can be used to lubricate the movement of the piston 106 within the combustion chamber 105, and the movement of the valves 102 in their respective intake or exhaust ports.

In operation, particulate matter from the environment (e.g., dust, salt, dirt, and the like) and from the combustion process can accumulate within the engine 100 (e.g., as sludge, varnish, or hard carbon). For example, oil is distributed throughout moving components of the engine 100 via the oil circulation system 107 and can come in contact with and adhere to the accumulated particulate matter, forming a viscous sludge with a decreased lubricating ability. This viscous sludge also forms via a thermal and oxidative degradation process caused by oil contacting hot metal surfaces in the power cylinder. Over the course of continuing oil circulation, the sludge and associated particulate matter can accumulate at certain areas associated with the combustion chamber 105, such as on and around the valves 102 or on and around the piston 106, the piston ring 108, and any grooves associated with the piston ring 108. A piston ring 108 may ultimately seize or otherwise fail to provide a seal with the inner wall of the combustion chamber 105, and/or a valve seal 104 may fail to provide an adequate seal at an intake or an exhaust port. As a result of failing seals, an increased amount of oil can seep past the piston 106 and/or seep past the valves 102 and into the combustion chamber 105, where the oil is ignited along with fuel and air at every ignition cycle and expelled as exhaust, ultimately leading to an increase in oil consumption and an increase in pollution.

Certain formulations of oil are configured to remove accumulated particulate matter and decrease a viscosity of sludge within an engine and its oil circulation system. For example, such oil formulations include a non-petroleum-based oil such as a blend of base oils from at least two of the Groups III, IV and V, as these groups are defined by the American Petroleum Institute (API) and as disclosed in PCT application PCT/US15/25255, which is incorporated herein by reference. For example, Group IV base oils include polyalphaolefin base oils (PAO). Polyalphaolefin base oils may be derived from linear C2 to C32, preferably C6 to C16 alphaolefins. Feed stocks for the alphaolefins include 1-octene, 1-decene, 1-dodecene and 1-tetradecene. Group III base oils include, for example, GTL (gas to liquid) base stocks as well as base stocks formed under severe hydroprocessing that meet the sulfur, saturates content, and viscosity index requirements as set by the API for the Group III category. Group V base oils include alkylated aromatic compounds, polyalkylene glycols and ester base oils and mixtures thereof. One alkylated aromatic compound is an alkylated naphthalene. Alkylated naphthalenes are naphthalenes substituted with one or more short chain alkyl groups, such as methyl ethyl or propyl. Example alkyl substituted naphthalenes include alpha methylnaphthalene, dimethylnaphthalene and ethylnaphthalene. Synestic is a commercially-available alkylated naphthalene. Formulations may include lubricant additives typically found in automotive and diesel engine applications. These can include, for example, oxidation inhibitors, dispersants, metallic and non-metallic detergents, corrosion and rust inhibitors such as borate esters, metal deactivators, anti-wear agents, extreme pressure additives, pour point depressants, viscosity modifiers, seal compatibility agents, friction modifiers, defoamants, demulsifiers and others.

In one or more embodiments of the present disclosure, a lubricant formulation includes an ester-based oil, an alkylated naphthalene and a PAO. The PAO provides lubricity and oxidative stability, but contributes little if any solvency, and Group III base oils can be used in place of the PAO. The alkylated naphthalene provides oxidative stability, contributes to solvency and contributes to the requisite viscosity. Polyol esters can improve the solvency of the base oil mixture. These esters, together with the alkylated naphthalene, are added in amounts effective to establish the solvency with an aniline point between 20° C. and 115° C. and in particular embodiments between 50° C. and 95° C. The aniline point is the minimum equilibrium solution temperature for equal volumes of aniline and a sample. In this case, the sample is the base oil blend. It should be noted that when specifying the range of aniline point for the desired base oil blend, it is understood that up to 25% of the formula may include other additives. In one or more embodiments of the present disclosure, the lubricant formulation can include about 50% of the polyol ester, in particular Priolube 1973, 10% of an alkylated naphthalene and 20% PAO. Running these or similar oil formulations through the oil circulation system of an engine exhibiting a problematic degree of oil consumption can eliminate the need to open up and manually clean an engine with failing combustion chamber seals to restore oil consumption to normal levels.

Figure 2:
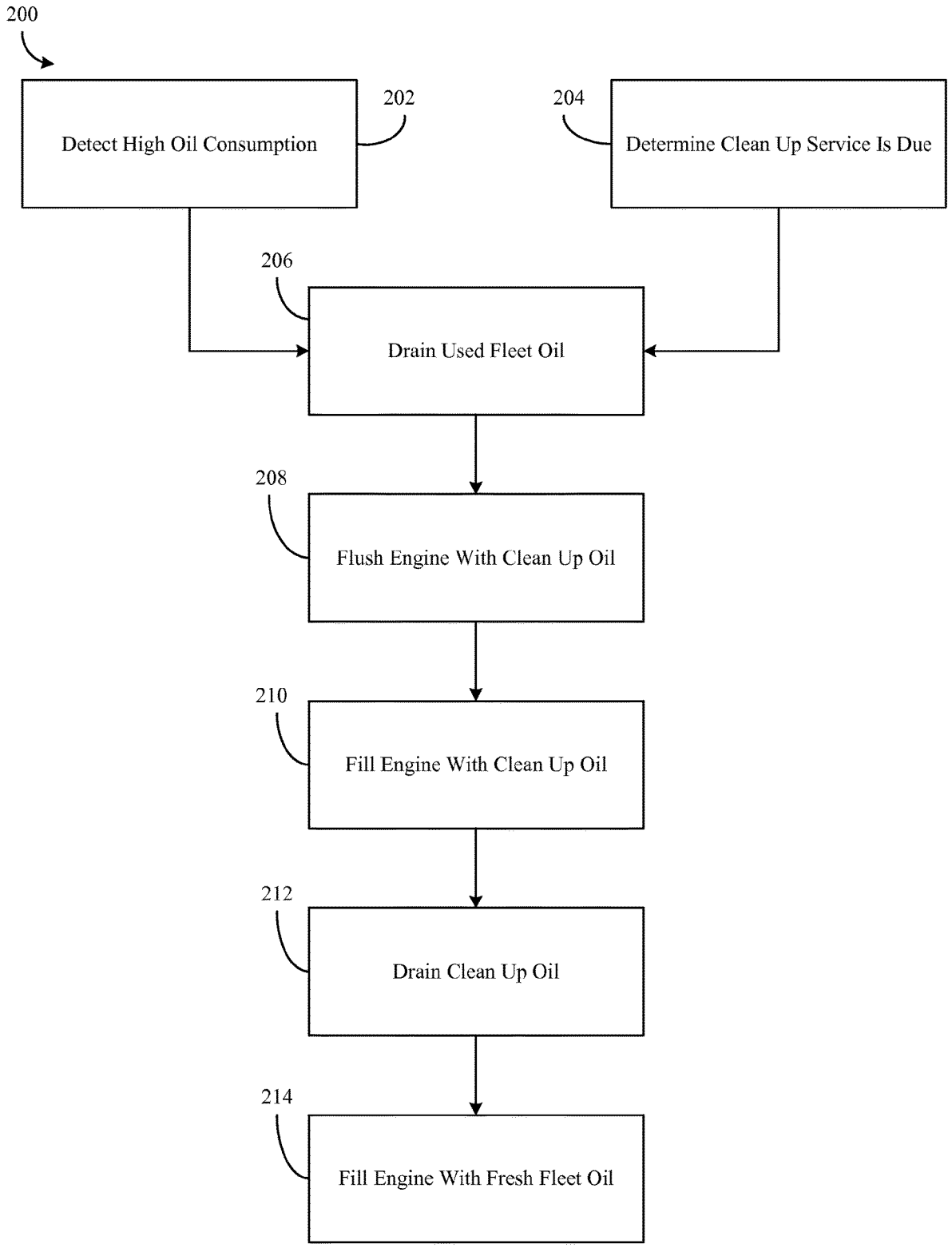
FIG. 2 is a flow diagram of a method of performing an oil cleanup service, according to an example embodiment.

Referring to FIG. 2, a flow diagram of a method 200 of performing an oil cleanup service is shown. In using the formulations described above in the manner discussed below to free piston rings, dissolve sludge, and remove previously built-up carbon deposits on engine pistons, the oil in the engine is drained and replaced with a formulation having significant solvency, such as one with an aniline point of about 60° C. The engine is operated with the oil cleanup formulation until the next oil change (e.g., in a vehicle, 20,000-30,000 miles of operation for a diesel engine and 5000 miles for a gasoline engine), at which point the oil can be replaced with standard engine oil formulation. The efficacy of the cleanup formulation can be determined by comparing oil consumption in the engine before and after use of the formulation.

In FIG. 2, at 202, high oil consumption is detected. High oil consumption is relative to an expected oil consumption for the type and age (or usage) of the associated engine, and can be detected by, for example, regular monitoring of oil levels within an engine (e.g., engine 100). Oil levels can be monitored in several ways, including checking a dipstick removably disposed within an engine that is configured to indicate the level of oil within the engine (e.g., a removable metal extension with incremental marks corresponding to volumes of oil in an oil sump). For example, excessively high oil consumption may be indicated if an engine is consuming a quart of oil every 200 to 2,000 miles of operation. Alternatively, oil levels can be monitored automatically, for example where a vehicle equipped with an internal combustion engine is configured to detect and signal to a user problematically low oil levels (e.g., a "check oil" light on a vehicle display). If monitoring reveals that the engine's oil levels are depleting at an unusual or problematic rate, high oil consumption can be detected.

In certain embodiments where oil levels are monitored automatically, a vehicle with an internal combustion engine may include a controller structured to perform certain operations to monitor oil levels. The controller can form a portion of a processing subsystem including one or more computing devices having memory, processing, and communication hardware. The controller may be a single device or a distributed device, and the functions of the controller may be implemented by way of hardware, firmware or software, or a combination thereof (e.g., such as by a processor executing computer instructions from a non-transient computer readable storage medium). In certain such embodiments, the controller includes one or more modules structured to functionally execute the operations of the controller. The description herein including modules emphasizes the structural independence of the aspects of the controller, and illustrates one grouping of operations and responsibilities of the controller. Other groupings that execute similar overall operations are understood within the scope of the present application. A module may be implemented by way of hardware, firmware or software, or a combination thereof (e.g., such as by a processor executing computer instructions from a non-transient computer readable storage medium). Modules may be distributed across various components.

Example and non-limiting module implementation components include sensors providing any value determined herein, sensors providing any value that is a precursor to a value determined herein, datalink and/or network hardware including communication chips, oscillating crystals, communication links, cables, twisted pair wiring, coaxial wiring, shielded wiring, transmitters, receivers, and/or transceivers, logic circuits, hard-wired logic circuits, reconfigurable logic circuits in a particular non-transient state configured according to the module specification, any actuator including at least an electrical, hydraulic, or pneumatic actuator, a solenoid, an op-amp, analog control components (springs, filters, integrators, adders, dividers, gain components), and/or digital control components.

In some embodiments, the controller includes a sensor module configured to determine the volume of oil in an engine (e.g., the volume of oil in an oil sump) and an indicator module configured to trigger a warning signal to a user (e.g., a dashboard light indicator) when the oil level drops below some minimum volume.

Referring still to FIG. 2, at 204 it is determined whether or not a cleanup service is needed. Cleanup service intervals can be determined in a variety of ways. For example, statistical analyses for a particular line of engines providing a common level or type of service can yield a finding that high oil consumption arising from failing combustion chamber seals (e.g., a piston ring 108) tends to occur after some measurable increment of time or use (e.g., after 100,000 miles driven, or after five years of service). Upon the completion of the predetermined amount of time or use, a cleanup service can be due.

At 206, if high oil consumption is detected at 202 or it is determined that a cleanup service is due at 204, a cleanup service can be instituted by first draining used fleet oil from the engine. Used fleet oil is standard motor oil that does not include the cleanup formulation and properties discussed above, and has been circulated through the engine during operation. Used fleet oil can be drained from an engine by opening the engine's oil pan (e.g., via a drain plug disposed in the oil sump 110) and allowing the fleet oil to flow out of the engine.

At 208, the engine is flushed with a flushing cleanup oil. The flushing cleanup oil includes the cleanup formulation and properties discussed above. The engine can be flushed with the flushing cleanup oil by, for example, concurrently adding and draining the flushing cleanup oil to the engine's oil circulation system (e.g., oil circulation system 107) while the engine is operating to a low degree (e.g., at idle). In some arrangements, the flushing cleanup oil includes a mixture of non-cleanup fleet oil and cleanup oil. In other arrangements, the flushing cleanup oil is a formulation of cleanup oil without a mixture with non-cleanup fleet oil.

At 210, the engine is filled with an operating cleanup oil. The engine can be filled with the operating cleanup oil by closing the oil pan and filling the engine with a predetermined amount of the operating cleanup oil (e.g., equivalent to the appropriate amount of standard fleet oil as called for by the engine's specifications). In some arrangements, the operating cleanup oil is a mixture of non-cleanup fleet oil and cleanup oil. In other arrangements, the operating cleanup oil is a formulation of cleanup oil without a mixture with non-cleanup fleet oil. In some arrangements, the flushing cleanup oil from 208 is preserved and reused (e.g., after filtering) as the operating cleanup oil at 210. The formulation of the operating cleanup oil may vary from the formulation of the flushing cleanup oil. For example, the flushing cleanup oil may have a more aggressive cleanup formulation relative to the operating cleanup oil. In addition, the operating cleanup oil may include a mixture of non-cleanup fleet oil and cleanup oil while the flushing cleanup oil includes a formulation of cleanup oil without a mixture with non-cleanup fleet oil.

At 212, the operating cleanup oil is drained from the engine. The operating cleanup oil can be drained from the engine in the same manner that fleet oil is drained at 206. However, in some arrangements, the operating cleanup oil is drained after an operation interval of some amount of time or use since the engine was filled with the flushing cleanup oil. In one such arrangement, the operation interval is the same as the appropriate duration of use for a fill of non-cleanup fleet oil. In other such arrangements, the operation interval is a shortened or lengthened period of use relative to the appropriate duration of use for a fill of non-cleanup fleet oil. In a particular implementation, the operation interval with the operating cleanup oil is at least 30,000 miles, although the interval may vary depending upon a variety of factors. In other embodiments, the operation interval is at least 20,000 miles.

At 214, the engine is filled with fresh fleet oil. Fresh fleet oil is standard, non-cleanup oil that has not yet been circulated through an engine, or has been refurbished after previous use in an engine. The engine can be filled with fleet oil in the same manner that the engine is filled with operating cleanup oil at 210.

It should be noted that the orientation of various components (e.g., "top," "bottom," etc.) are with respect to the orientation illustrated, and may differ for illustrations of different embodiments, and that such variations are intended to be encompassed by the present disclosure. It is recognized that features of the disclosed embodiments can be incorporated into other disclosed embodiments.

It is important to note that the constructions and arrangements of apparatuses or the components thereof as shown for the various embodiments are illustrative and not limiting. Although a few embodiments have been described in detail in this disclosure, those skilled in the art who review this disclosure will readily appreciate that many modifications are possible (e.g., variations in sizes, dimensions, structures, shapes and proportions of the various components, values of parameters, mounting arrangements, use of materials, colors, orientations, etc.) without materially departing from the teachings and advantages of the subject matter disclosed. For example, components shown as integrally formed may be constructed of multiple parts or components, the position of components may be reversed or otherwise varied, and the nature or number of discrete components or positions may be altered or varied. The order or sequence of any process or method steps may be varied or re-sequenced according to alternative embodiments. Other substitutions, modifications, changes and omissions may also be made in the design, operating conditions and arrangement of the various embodiments without departing from the scope of the present disclosure.

The indefinite articles "a" and "an," as used herein in the specification and in the claims, unless clearly indicated to the contrary, should be understood to mean "at least one."

The claims should not be read as limited to the described order or components unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

What is claimed is:

1. A method of performing a cleanup service on an internal combustion engine, the method comprising:

draining used fleet oil from the internal combustion engine;

filling the internal combustion engine with a first cleanup oil;

operating the internal combustion engine with the first cleanup oil until the next oil change interval;

draining the first cleanup oil; and filling the internal combustion engine with fresh fleet oil.

2. The method of claim 1, further comprising, before filling the internal combustion engine with the first cleanup oil, flushing the internal combustion engine with a second cleanup oil.

3. The method of claim 2, wherein the first cleanup oil or the second cleanup oil comprises an ester-based oil, an alkylated naphthalene and a polyalphaolefin base oil.

4. The method of claim 2, wherein the first cleanup oil has a same formulation as the second cleanup oil.

5. The method of claim 2, wherein the first cleanup oil has a different formulation than the second cleanup oil.

6. The method of claim 2, wherein the first cleanup oil or the second cleanup oil comprises a non-petroleum-based oil.

7. The method of claim 1, wherein operating the internal combustion engine until the next oil change interval comprises operating the internal combustion engine for at least 20,000 miles.

8. The method of claim 1, wherein the first cleanup oil dissolves at least one of sludge, varnish, and hard carbon in the internal combustion engine and wherein draining the first cleanup oil includes draining the dissolved at least one of sludge, varnish, and hard carbon from the internal combustion engine.

9. The method of claim 8, wherein the dissolving and draining of the at least one of sludge, varnish, and hard carbon cleans an interior of the internal combustion engine.

10. The method of claim 1, wherein the first cleanup oil has an aniline point that provides significant solvency within an operating temperature range of the engine.

11. The method of claim 1, further comprising repeating the cleanup service periodically after a predefined duration of operation of the internal combustion engine.

12. The method of claim 1, further comprising:

monitoring an oil level within the internal combustion engine;

detecting high oil consumption based on the monitored oil level; and performing the cleanup service in response to the high oil consumption.

13. The method of claim 12, wherein detecting high oil consumption comprises detecting a change in the monitored oil level of one quart of fleet oil within a range between 200 and 2,000 miles.

14. The method of claim 1, wherein operating the internal combustion engine until the next oil change interval comprises operating the internal combustion engine for the appropriate duration of use for a fill of fresh fleet oil.

15. A method of performing a cleanup service on an internal combustion engine, the method comprising:

filling the internal combustion engine with a first cleanup oil;

operating the internal combustion engine with the first cleanup oil until the next oil change interval;

draining the first cleanup oil from the internal combustion engine; and filling the internal combustion engine with fresh fleet oil.

16. The method of claim 15, further comprising flushing the internal combustion engine by concurrently adding a second cleanup oil into the internal combustion engine and draining the second cleanup oil from the internal combustion engine for a first period of time, and draining the second cleanup oil from the internal combustion engine after the first period of time, wherein the first cleanup oil has a same formulation as the second cleanup oil.

17. The method of claim 15, further comprising flushing the internal combustion engine by concurrently adding a second cleanup oil into the internal combustion engine and draining the second cleanup oil from the internal combustion engine for a first period of time, and draining the second cleanup oil from the internal combustion engine after the first period of time, wherein the first cleanup oil has a different formulation than the second cleanup oil.

18. The method of claim 15, wherein operating the internal combustion engine until the next oil change interval comprises operating the internal combustion engine for at least 20,000 miles.

19. The method of claim 15, wherein the first cleanup oil comprises a non-petroleum-based oil.

20. The method of claim 15, wherein the first cleanup oil dissolves at least one of sludge, varnish, and hard carbon in the internal combustion engine and wherein draining the first cleanup oil includes draining the dissolved at least one of sludge, varnish, and hard carbon from the internal combustion engine.

21. A method of performing a cleanup service on an internal combustion engine, the method comprising:

filling the internal combustion engine with an operating cleanup oil comprising an ester-based oil, an alkylated naphthalene and a polyalphaolefin base oil;

operating the internal combustion engine with the operating cleanup oil until the next oil change interval;

draining the operating cleanup oil from the internal combustion engine; and filling the internal combustion engine with fresh fleet oil.

22. The method of claim 21, wherein the operating cleanup oil further comprises non-cleanup fleet oil.

23. The method of claim 21, wherein operating the internal combustion engine until the next oil change interval comprises operating the internal combustion engine for at least 20,000 miles.

24. The method of claim 21, wherein the operating cleanup oil comprises a non-petroleum-based oil.

25. The method of claim 21, wherein the operating cleanup oil dissolves at least one of sludge, varnish, and hard carbon in the internal combustion engine and wherein draining the operating cleanup oil includes draining the dissolved at least one of sludge, varnish, and hard carbon from the internal combustion engine.

* * * * *